United States Patent [19]

Broek

[11] Patent Number: 4,658,966

[45] Date of Patent: Apr. 21, 1987

[54] HANGING FILE FOR BLUEPRINTS AND THE LIKE

[76] Inventor: Daniel Broek, 2138 W. Dixon St., Mesa, Ariz. 85201

[21] Appl. No.: 845,515

[22] Filed: Mar. 28, 1986

[51] Int. Cl.[4] ..... A47F 7/16

[52] U.S. Cl. ..... 211/46; 211/48; 248/217.1

[58] Field of Search ..... 211/45–48; 248/214, 215, 217.1, 222.2, 222.3, 309.1, 447

[56] References Cited

U.S. PATENT DOCUMENTS

| | | | |
|---|---|---|---|
| 3,221,892 | 12/1965 | Morcheles et al. | 211/48 |
| 4,155,607 | 5/1979 | Sitler et al. | 211/46 X |
| 4,503,979 | 3/1985 | Morand | 211/48 X |

*Primary Examiner*—Carl D. Friedman
*Assistant Examiner*—Naoko N. Slack
*Attorney, Agent, or Firm*—Charles P. Padgett, Jr.

[57] ABSTRACT

The present invention provides a hanging file system for releasably suspending a plurality of relatively large flat pages of blueprints or the like in a hanging relationship to one another including a generally rectangular rack portion having a plurality of pins extending from the lower portion of a rear member of the rack. A binder has an aperture formed in one end for operatively engaging one of the pins and a hanger forming having a slotted channel for operatively receiving the front member of the rack therein for hangably supporting the binder and the plurality of pages contained therein from the rack. The outer front end portion of the binder contains a flared opening for guiding the pages into the channel and between the lower gripping jaws which are resiliently biased by the plastic material itself toward one another for clampably retaining the pages with the hollow channel of the binder. The holder is located a predetermined distance from the apertured end and short of the center of the binder such that the center of gravity causes the binder to attempt to rotate the apertured end clockwise about a pivot formed by the hanger engaging the front rack portion. Motion is prevented since the rear or apertured end of the binder is stopped by the lower surface of the rear rack support of the rack for maintaining the binder in a generally horizontal position for vertically suspending the plurality of pages therefrom. A loose connection of the hanger to the front support of the rack enables the binders to be pivoted in a horizontal manner about the pin-receiving aperture at the end thereof for turning the pages horizontally through an arc to enable the individual pages of a packet or individual packets of different binders to be read or scanned and so that individual pages can be removed from, reinserted in or initially inserted in individual binders without removing the binders from the racks and without moving all of the pages therefrom.

41 Claims, 6 Drawing Figures

HANGING FILE FOR BLUEPRINTS AND THE LIKE

BACKGROUND OF THE INVENTION

1. Field of the Invention

The present invention is related generally to hanging files, and more particularly to improved hanging files for operatively suspending a plurality of relatively large flat sheets or pages of blueprints or the like in such a manner so that the pages can be easily scanned or read while on the rack without interference from one another.

2. Description of the Prior Art

Typically, in the prior art, relatively large flat pieces of paper or sheets of documents or the like, such as blueprints, were rolled into tight elongated rolls and placed in a generally cylindrical, cardboard, metal or plastic storage tube. These tubes were then labeled with the document or documents which were contained therein. However, when a person was searching for a particular document, he had to read the notations on the tubes, open the correct tube, remove the rolled pages, unroll the documents, separate the documents and read each one, and then roll the documents not required back into a roll and re-insert them again into the tube. All of this takes considerable time and effort, not to mention the frustration usually resulting from trying to read through previously rolled documents which have a tendency to try and roll up continuously while you are attempting to read or scan them.

Recently, however, various types of hanging files have been used. In the typical hanging file generally in use for blueprints and the like today, an aluminum or metal binder is suspended from it a pair of distending metal job portions, and the blueprints can be placed within the metal jaws. The jaws are then closed by mechanical means carried on the binder itself for closing the jaws to clamp the top edges of the blueprints or the like therein. Since this system utilizes relatively expensive and heavy metals parts and mechanical locking means, it is relatively expensive and difficult to repair and/or maintain, but it is in use commercially today. Furthermore, such systems are difficult, if not impossible, to read while various binders suspend the documents therefrom but must first be pulled or removed from the rack or storage unit, and then each of the mechanical means carried by the binder must be opened to release the jaws so that pages can be removed and studied. After a desired page is found, the remaining pages must be reinserted into the clamping mechanism and each of the clamps carried by the binder locked again before the unit is restored to its position on the rack or carrying means.

Therefore, the systems of the prior art are very time consuming, expensive, difficult to use and maintain, and relatively bulky and heavy to use. The present invention solves substantially all of the problems of the prior art hanging file systems while incorporating none of its shortcomings.

SUMMARY OF THE INVENTION

It is an object of the present invention to provide a low cost, relatively light-weight, easy-to-use and easy-to-maintain hanging file for blueprint documents and the like.

It is another object of the present invention to provide a hanging file system wherein individual pages or groups of pages may be quickly and easily secured without removing the binder from the rack.

It is still another object of the present invention to provide an improved binder strip having an elongated channeled slot substantially the length thereof for receiving the top edges of the pages of documents stored therein and lower clamping jaws for gripably resiliently retaining the stored documents therein and suspending same from a hanging file rack.

It is yet another object of the present invention to provide a hanging file system without manually-operated mechanical clamping means.

It is a further object of the present invention to provide a hanging file system wherein the resilient bias of the plastic material used in forming the binder strip resiliently closes the lower jaws at the end of the sides to retainably grip a plurality of pages inserted into the channel therebetween for hanging same in a generally vertical manner.

It is still another object of the present invention to provide an improved hanging file system which may be either wall-mounted or floor-mounted.

It is yet another object of the present invention to provide a hanging file system having a binder strip which is horizontally rotatable through an arc upon the rack for ease of scanning the pages of documents secured therein for removing, inserting, or reinserting one or more documents into a given binder.

It is yet a further object of the present invention to provide a hanging file system binder strip having sides for forming a channel slot therein for receiving the top edge portions of the pages suspended therein a pair of lower clamping jaws resiliently biased by slot or channel-forming walls from one another to positively clamp the plurality of pages therebetween for suspending them in a horizontal manner without manually-operated clamping mechanism.

It is still another object of the present invention to provide a hanging means on the top portion of the binder spaced a predetermined distance from an apertured end such that the center of gravity of the binder means and plurality of pages contain therein is outside or forward of the handle of the hanging member for suspending the pages from the hanging member in a generally vertical manner.

These and other objects and advantages of the present invention will be more fully understood from reading the detailed description of the invention, the claims, and the drawings which are briefly described hereinbelow.

DETAILED DESCRIPTION OF THE PREFERRED EMBODIMENT

Figure 1:
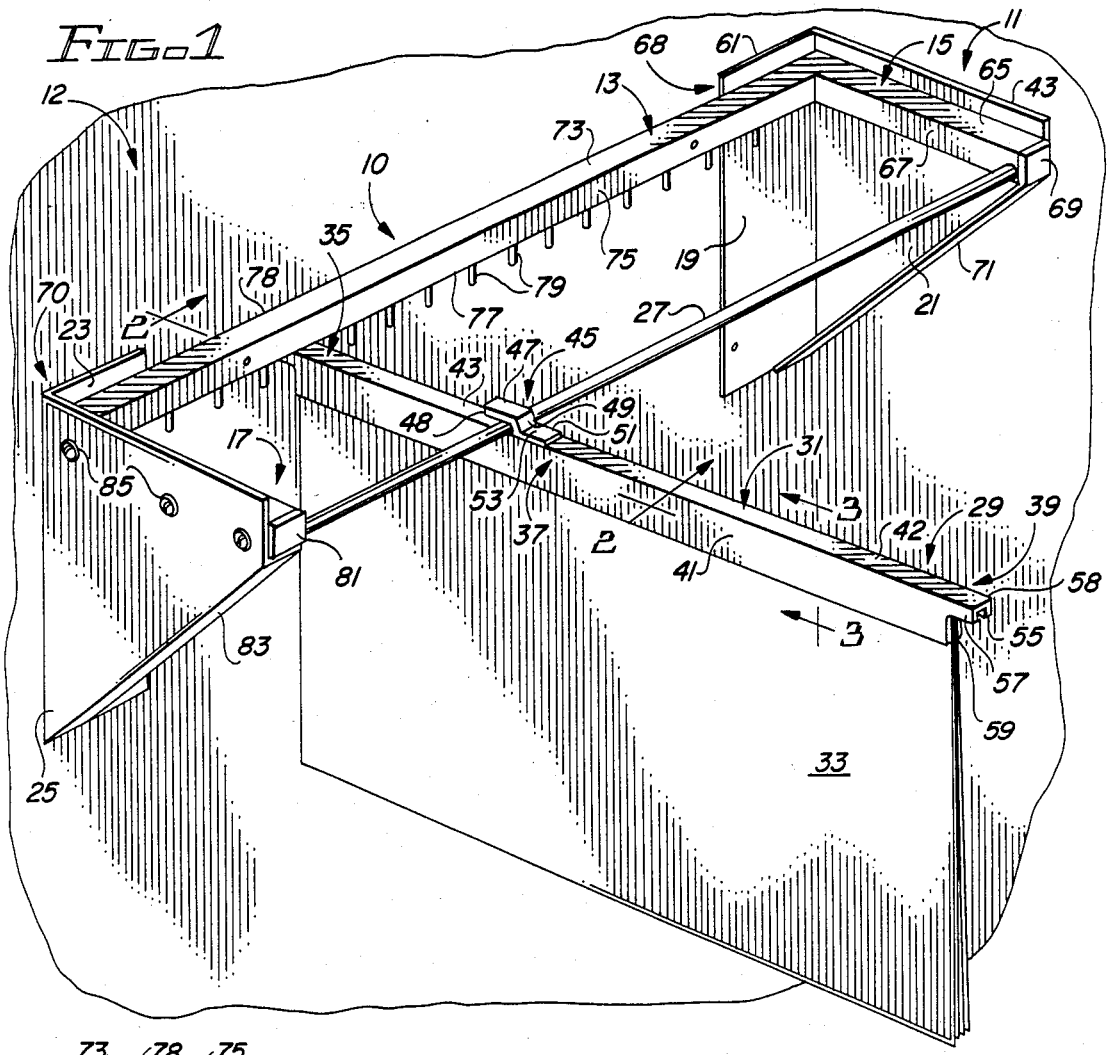
FIG. 1 is an orthographic view of one embodiment of the preferred embodiment of the hanging file system of the present invention.

FIG. 1 shows the hanging file system or apparatus 11 of the present invention hanging or coupled from a wall 12 a predetermined distance above the floor. The hanging file system 11 includes a generally rectangular horizontal rack 10 having a first generally elongated rear support member 13 having a longitudinal axis therethrough and having a generally rectangular cross-section. The rack 10 also includes a first side support member or end support member 15 integral with the rear support member 13 and extending forwardly thereof and generally perpendicular to the longitudinal axis thereof. A second end portion or side support member 17 is integral with the opposite end portion of the rear support member 13 and extends forward thereof and generally perpendicular to the axis thereof. The cross-section of each of the support members 13, 15 and 17 is generally rectangular for the hollow metal members with the hollow forward end of the first side support member 15 closed or covered by a capping plug 69 and the hollow forward end of the second or opposite side support member 17 being capped or closed by the capping member 81. An aperture is provided on the inside surface of each on the forward or capped end portions of each of the side support members 15 and 17 for retaining opposite ends of a generally elongated cylindrical rod 27 which acts as the forward support member.

The rear support member 13 includes an upper surface, top, or top portion 73, an inside elongated surface 75, a bottom surface or bottom portion 77 and an outside or rear surface 78. The lower surface or bottom portion 77 of the elongated rear support member 13 includes a plurality of generally cylindrical pin members 79 which are equally spaced from one another and spaced at predetermined integrals substantially along the length of the rear support member 13. Each of the pin members 79 extend vertically downward and are generally perpendicular to the lower surface 77 of the rear support member 13 for use as hereinafter described. The side members 15, 17 also include a top portion or upper surface 65 and an inwardly facing surface or side 67. The combination of the rear support member 13, the side support members 15 and 17, and the front support member or cylindrical rod 27 form a generally rectangular rack or frame 10 which is adapted to be mounted either to a wall 12 or to a floor rack support or mounting means, not shown, but obvious from FIG. 1.

A pair of brackets 68 and 70 include generally L-shaped portions including a rear portion 19, 23 and a side portion 21, 25 of the first and second bracket portion 68 and 70, respectively. The rear portions or rear bracket plates 19 and 23 are generally rectangular in shape and adapted to be fixedly retained or secured to a portion of the wall 12 as by conventional screw fasteners or the like, not shown, but wellknown in the art. The side portions 21 and 25 of the brackets 68 and 70, respectively, are generally trapazoidal in shape and the plane of each is generally perpendicular to the plane of the rear plates 19 and 23 and are adapted to be connected to the exterior surface of the end support members 15 and 17 by screw fasteners 85 or the like. The rear portions 19 and 23 and side portions 21 and 25 are integral with one another to form an L-shaped integral bracket 68 and 70, respectively, and each includes a front diagonal portion or plate member 71 and 83 extending from just below the front or open end of the side members 15 and 17 and the junction of the base and side portions 21 and 25 with the rear portions 19 and 23, respectively.

The hanging file system 11 of FIG. 1 includes a binder means or binder system 29 including a generally elongated binder strip member 31 having a generally horizontal top surface 43 and a pair of downwardly extending side portions or legs 41 and 42, respectively. The legs 41 and 42, together with the top surface 43 form a generally inverted U-shaped member having a slot or channel 55 formed between the downwardly extending leg members 41 and 42 and extending substantially a predetermined distance less than the length of binder strip 31. A plurality of pages of documents 33 such as blueprints or the like have the top end or edge portions thereof operatively received within the channel or slot 55 formed by the sides 41 and 42 and retained therein solely by the resilient bias of the clamping jaws 59 of the lower end portion of the sides 41 and 42 which are resiliently biased tightly against one another to clampably retain the plurality of pages 33 within the channel slot 55 between the clamping jaws 59 so as to maintain the pages suspended in a generally vertical manner. The forward end of the binder 31 includes an extension portion 39 having a portion of the channel or slot 55 formed therein and a portion of the sides 41 and 42 extending downward from the top surface 43 a predetermined distance and designated by partial side surfaces 57 and 58, respectively. The opposite end portion 35 of the binder strip 31 includes an aperture, as hereinafter described, for receivably engaging one of the pin members 79 downwardly therethrough.

Furthermore, the top surface 43 of binder 31 has a generally squared, Z-shaped holding or hanger element 45 mounted thereon. The Z-shaped holding element or holder 45 includes a first generally short vertical leg portion 49 and a first or lower elongated leg portion 51 extending toward the open end of the binder strip 31 and a second or upper elongated leg portion 47 extending in the opposite direction toward the apertured end of the binder strip 31. The relatively flat plane of the first or lower elongated leg 51 is adapted to be operatively secured to the top surface 43 of the binder 31 as by screw fasteners, bolt/nut means, rivets 53 or the like. By mounting the lower leg 53 to the top surface 43, the horizontal leg portion 49 serves to suspend the upper elongated leg 47 a predetermined distance above the upper surface 43 of the binder 31 so as to form a slotted channel 48 between the lower surface of the upper member 43 and the upper top surface of the binder 31 for operatively receiving the cylindrical rod or front support member 27 of the rack 10 therein. The holder apparatus 45 is located a predetermined distance from the apertured end 35 of the binder 31 which is significantly less than one half of the length of the binder strip 31 so that the center of gravity of the binder strip 31 and the plurality of pages 33 operatively secured therein is forward of the holder toward the open or slotted end 55 such that the center of gravity tends to try to rotate the binder strip 31 clockwise about a pivot point formed by the holder 45 on the rod 27, but the top surface 43 of the opposite end 35 of the binder 31 abuts against the lower surface 77 of the end of the rear support member 13 for preventing the clockwise rotation beyond the horizontal and operatively securing the binder 31 on the rack 10 for suspending the plurality of pages 33 therefrom in a generally vertical hanging manner.

Furthermore, the length of the elongated slot 48 formed between the lower surface of the member 47 and the upper surface 43 of the binder strip 31 loosely fits about the rod 27 so as to be movable in a sideways direction about a pivot point established by the pin member 79 within the aperture at the end 35 of the binder strip 31 so that various binders each mounting various pluralities of pages 33 can be turned, much the same as pages in a book, with the hanger 45 slidable along at least a portion of the rod 27 to enable the documents within various ones of the binders 31 to be individually examined, read or scanned without removing the binder strip 31 from the rack and without removing the pages 33 from the binder 31.

Figure 2:
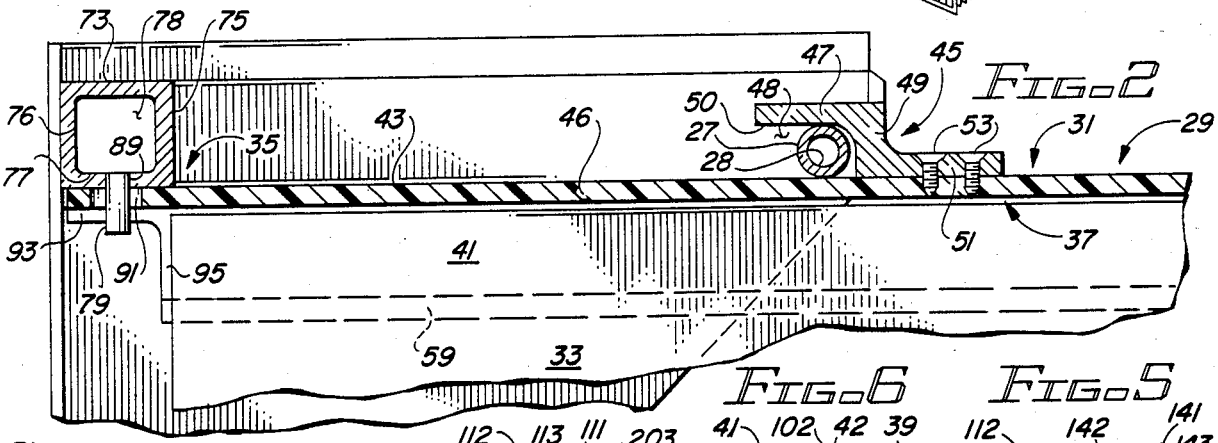
FIG. 2 is a sectional view of a portion of the hanging file system of FIG. 1 showing the end portions of the binder file which are coupled to the horizontal rack of FIG. 1.

FIG. 2 shows some of the connected portions of the binder 31 with the rack 10 of FIG. 1. In FIG. 2, a cross-section of the rear support member 13 is shown as including a forward or front surface 75, a top edge side 73, a rear side 76, a bottom side 77, each of the sides 73, 75, 76, 77 being integral with one another for forming a generally square cross-section with a generally hollow square interior 78 centrally therebetween. A plurality of pins 79 have one end portion operatively secured within or to the lower end or surface 77 of the rear support member 13. Each of the pins 79 is operatively disposed within the aperture 91 formed at the end portion 35 of the binder strips 31. The slot-forming sides 41 and 42 of the binder 31 are shown as terminating at the rear surface at ends 95 with the upper top portion 43 and a portion of channel-forming sides 57 and 58 extending forwardly via extension 93 for forming the aperture 91 through the end portion 35 thereof adjacent the rear distal end of the binder 31. In addition to the pin 79 passing through the aperture 91 at the rear end of the binder 31, the generally squared Z-shaped member or holder 45 is shown as having the bottom leg 51 retainably secured to the top 43 of the binder 31 by screw fasteners 53. The intermediate or vertical leg 49 is shown as positioning the second or upper horizontal leg 47 disposed toward the apertured end 35 of the binder 31 such that the ends 47 and 51 are generally parallel to one another and parallel to the plane of the surface 43 but face in opposite directions while the intermediate or upright member 49 is generally perpendicular thereto. The member 47 forms a channel, recess, or slot 48 between the lower surface 50 of the upper member or leg 47 and the upper surface 43 of the binder 31 for forming the a channel or slot 48 for loosely receivably retaining the forward support member 27 therein.

In FIG. 2, the forward support member or rod 27 is shown as being a generally hollow cylindrical tube having wall portions 27 and a centrally hollow interior 28. It will be observed that the portion 47 of the holder 45 is suspended from the point of contact of the lower surface 50 of member 47 with the upper end of the rod 23 for hangingly suspending the binder member 31 therefrom. The binder member 31 is shown as having a top portion 46 and a pair of downwardly extending sides 41 and 42 for forming a channel and clampably holding the pages 33 therein as shown in FIG. 1. Furthermore, the holder 45 is spaced a predetermined distance from the apertured end 35 of the binder means 31 so that the actual center of gravity of the combined binder strip 31 and suspended plurality of pages 33 is forward of the holder member 45 toward the open end 39. The weight of the combined pair acts to attempt to rotate the binder means 31 and pages 33 counterclockwise about the pivot formed by the point of contact of the member 47 with the rod 27. This motion is stopped by the abutment or contact of the upper surface 43 of the end portion 35 of the binder 31 contacting the lower surface 77 of the rear support member 13 about the extension portion 93 around the aperture 91 preventing such rotation and enabling the holder mechanism 45 to hangably suspend the binder 31 and pages 33 suspended therefrom and maintain them in a generally horizontal manner while the pages are suspended generally vertically downward therefrom.

Figure 3:
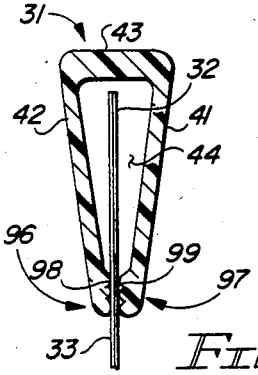
FIG. 3 is an end view of a cross-section of the binder means of FIG. 1.

FIG. 3 shows a cross-section of the binder strip 31 of FIGS. 1 and 2. In FIG. 3, the binder strip 31 is shown as having an upper end portion 43 which is generally horizontal and which connects to two downwardly suspended legs or leg members 41 and 42. The legs 41 and 42 have their upper end portions integral with the opposite ends of the horizontal member 43 and are preferably tapered inward toward the lower end portions thereof which terminate in clamping jaws 96 and 97, respectively. The portion between the downwardly distending legs 41 and 42 forms a channel or slot 44 for operatively receiving the top end portions or edge of the plurality of papers 33 therein while the lower clamping jaws 96 and 97 are shown as including a plurality of generally rounded elongated ridge portions or such portions having generally flattened opposing ridges extending substantially the length of sides 41 and 42 of the binder strip 31 with the interior facing surfaces of the jaws 96 and 97 being generally rounded and facing one another. The binder member 31 is preferably made of a generally resilient plastic material with memory such that the normal natural bias of the downwardly distending leg members 41 and 42 cause the clamping jaw portions 96 and 97 to be normally biased tightly against one another to form resiliently closable jaws between the teeth or ridge members 98 and 99 for retainably clamping the upper end portion 32 of the plurality of pages 33 within the slotted channel 44 and between the jaws 96 and 97, respectively. In this manner, the plurality of pages 33 are normally hung or suspended from the clamping jaws 96 and 97 in a generally vertical manner while the binder member 31 is supported in a generally horizontal position upon the tubular rod 27 within the channel, slot, or recess 48 into which the rod 27 is received.

Figure 4:
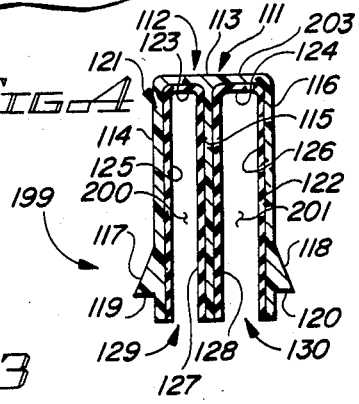
FIG. 4 is a cross sectional view of an alternate embodiment of the a binder means of the preferred embodiment of the present invention.
Figure 5:
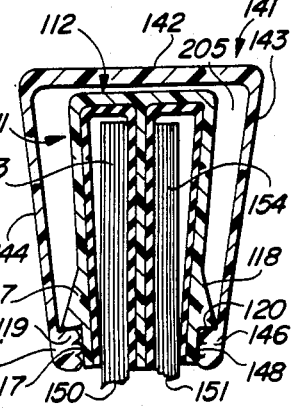
FIG. 5 is a view of the coupling means of the binder system of FIG. 4.

FIG. 4 illustrates that coupling means 112 and the first and second generally inverted U-shaped members 121 and 122 of FIG. 5. FIG. 4 shows a first, generally inverted, U-shaped member having a relatively short interconnecting horizontal upper portion 123 integral with a pair of downwardly distending, generally vertical leg member 125 and 127. The interior surfaces of the leg members 125 and 127 form a generally channeled slot 100 therebetween for operatively receiving the upper end portions 32 of the plurality of pages 33 of blueprints or the like therebetween. The open end 129 of the first inverted U-shaped member 121 is used to suspend the lower end portions of the plurality of pages 33 therethrough. A second generally inverted U-shaped member 122 includes a similar, relatively short upper portion 124 and a pair of downwardly distending integral legs extending from opposite ends of the horizontal portion 124 with the legs bearing reference numeral 128 and 126, respectively. The hollow interior channel or slot 201 between the legs 126 and 128 are adapted to operatively receive the upper end portions 32 of the plurality of pages 33 therein. It will be noted that the open end 130 of the slotted channel 201 is used to suspend the lower end portions of the plurality of pages 33 as was the open end 129 of the slotted channel 200 of the first inverted U-shaped member 121. It will be observed that the first and second inverted U-shaped members 121 and 122 are generally the same as one another although 122 may have a wider central aperture 201 or more widely spaced apart legs 126 and 128, or vise versa, if desired.

A coupling means 112 includes a generally horizontal, upper portion 203 and a pair of first and second downwardly distending leg members 114 and 116 integral with the ends of the horizontal support 203. The interior surface of the legs 114 and 116 are biased firmly against the exterior surfaces of the U-shaped members legs 125 and 126 and an intermediate downwardly extending member 115 integral with the mid-portion of the upper member 203 is disposed downwardly between the exterior surfaces of the opposite legs 127 and 128 of the U-shaped members 121 and 122, respectively. A notch-forming means 199 including a generally outwardly tapered portion 117 and 118 located at the lower end portions of the legs 125 and 126 and on the outer surfaces thereof a triangular portion 171 and 118 tapering from the exterior surface of the outside surfaces of the coupling members 114 and 116 and then sharply back at approximately a 90° angle to the exterior surface of members 114 and 116 for forming a notch 119, 120 behind said triangular portions 117 and 118 and adjacent the ends having the openings 129 and 130 therein. The purpose of the notches 119 and 120 formed by the triangular portions 117 and 118 will be hereinafter described with reference to FIG. 5.

FIG. 5 shows the coupling member 112 of FIG. 4 operably disposed within the binder means 141 of FIG. 5. FIG. 5 shows the binder member 141 as including a generally horizontal top portion 142 terminating at its opposite ends with a pair of downwardly extending leg portions 143 and 144 which are integral therewith. The legs 143 and 144 terminate in clamping jaw means 145 and 146, respectively. The resilient bias of the interior legs 114 and 116 of the coupling means 112 may serve to initially bias the slots or channels 200 and 201 closed about the open ends 129 and 130, but the resilient legs 143 and 144 of the binder 141 is heavily biased such that the lower end portions 145 and 146 are resiliently forced normally toward one another and preferably very close contact to one another so that no space exists therebetween. When the coupling means 112 of FIG. 4 is disposed within the hollow interior slot or channel 205 formed between the inner surfaces of the sides 143 and 144, the clamping jaws 145 and 146 at the lower ends of the legs 143 and 144 have their clamping surfaces 147 and 148 operatively received within the notches 119 and 120, and receivably are retained therein by the normal bias of the legs 143 and 144, respectively. The jaw portions 146 and 147, each include one or more generally elongated rib members extending substantially the length of sides 41 and 42 of the binder 31 and each of the interior facing ribs 147 and 148 have a generally rounded exterior surfaces facing one another for gripably retaining the lower end portion of the sides 114 and 116 of the coupling member 112 for forcing the openings 129 and 130 closed tightly upon the upper end portion 32 of the plurality of the pages 33 inserted within the channels 200 and 201 of the inverted U-shaped members 121 and 122, respectively. A plurality of pages 150 and 151 are shown as having their upper end portions 153 and 154 operatively inserted within the hollow interiors 200 and 201 of the inverted U-shaped members 121 and 122, respectively, while the coupling means and lower end portion of the jaws 145 and 146 clampably hold or retain the plurality of pages 150 and 151 therebetween by the natural or normal resiliency of the plastic material from which the binder 141, the coupling means 112, and the inverted U-shaped members 121 and 122 are manufactured.

Figure 6:
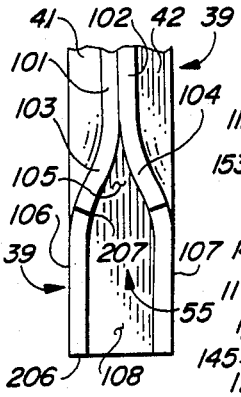
FIG. 6 is a bottom end view of the binder of FIG. 1.

FIG. 6 shows a botton end view of the open channel end 55 of the binder 31 of FIG. 1. In FIG. 6, the binder strip 31 is shown as including a hollow elongated central channel or slot 55 extending substantially the length thereof. The hollow channel 55 actually marks the opening of the channel 44 shown in FIG. 3 and the side legs 41 and 42 of the binder 31 are shown as terminating in closed clamping jaw portions having the lower ends 101 and 102. The opening of channel 55 is shown as having outwardly flared end portions 103 and 104 of sides 141 and 142 for defining a narrowing opening 105 to the slot or channel 55 for guiding the insertion of the top ends 32 of the pages 33 therein. Flared ends 103 and 104 surround the generally tapered opening 105 and serve to guide the feed of the upper end portions 32 into the elongated channel 44 and between the clamping jaws, not shown, immediately above the interior, oppositely facing, sides of the lower edges 101 and 102 of the sides 41 and 42, respectively. The flared end of the binder 31 can be the outermost end 39, the innermost end 35, none or both, as desired. The interior surface of the top member 53 is designated by reference numeral 108 as that portion of the top 43 of the extension 39 extending from the front end. The channel extensions 35 and 39 are provided on both ends of the binder 31 to allow for indirection and storage on other units or support frame. You set the extension end 80°–95°. The extension ends 35, 39 can be set or placed on the support section of a storage unit so that the blueprints hang vertically downwardly.

The binder 31 of the present invention provides for holding one or more packets or groups of a plurality of pages 33 of blueprints or any type of relatively large flat sheets of paper, plastic or the like for forming a hanging file using the natural resilience of the plastic material making up the binder strips 31 themselves. Each of the binder strips 31 comprises an elongated channel for holding the upper end portion 32 of the pages 33 and a lower clamping jaw for removably retaining the pages therein. It will also be noted that the pin connections at the rear end of the file and the intermediate holder assembly 45 enable the entire binders of files or pages 33 within individual binders to be turned substantially like pages in a book so that an individual plurality of pages or pages within a plurality can be scanned or read for locating a proper page for removing it, reinserting it or initially inserting a page, as desired. It will be observed that the entire operation can take place while the binder 31 remains on the rack 10 and the binder does not have to be removed therefrom for any reason. Furthermore, there is no need to move the entire packet of pages 33 from the binder 31 unless the entire packet is needed. Individual pages can be added to or removed from the individual packets or plurality of pages 33 as desired.

It will be obvious to those skilled in the art that various modifications, changes, alterations, and substitutions can be made in the present invention without departing from the spirit and scope thereof which is limited only the appended claims.

I claim:

1. A hanging file system for releasably suspending a plurality of relatively large flat pages in a hanging relationship of one another comprising:

an elongated rear support member having a lower edge portion, first and second end portions at opposite ends of said rear support member, and a longitudinal axis through said elongated rear support member;

first and second substantially identical end support members generally parallel to one another and having first and second end portions, one end portion of each of said first and second end support members extending forwardly from the first and second end portions of said rear support member, respectively, said first and second end support members being generally perpendicular to the axis of said rear support member;

a front support member operatively carried by said opposite end portion of said first and second end support members, said front support member being generally parallel to the axis of said rear support member and generally perpendicular to said end support members, said rear support member, said front support member, and said first and second end support members forming a generally rectangular frame means;

means for mounting said frame means at least a predetermined vertical distance above floor level;

a plurality of substantially evenly spaced pin means operatively carried by said lower edge portion of said rear support member and depending downwardly therefrom;

an elongated binder means including an elongated lower clamping jaw means extending almost the entire length thereof; and an elongated slot-forming means extending almost the length of said elongated binder means, means for forming an aperture means at one end of said elongated binder means for receivably engaging one of said plurality of pin means therein and means for operatively engaging said front support means for suspending said elongated binder means from said front support means, the relatively large flat pages being operatively received within said elongated slot for being clamped therein by said lower clamping jaw means for suspending said pages therefrom.

2. The file system of claim 1 wherein said means for engaging said front support means includes a generally Z-shaped holder means having a first leg operatively secured to the upper surface of said elongated binder means a second leg generally perpendicular to said first leg and integral therewith, and a third leg integral with said second leg and generally perpendicular thereto extending rearwardly toward said pin-receiving aperture means and being substantially parallel to said elongated binder means and spaced a given distance from the top surface thereof for forming a slotted channel for operatively receiving said front support means therein.

3. The file system of claim 2 wherein said holder means is disposed a predetermined distance from said apertured end, of said binder means and said predetermined distance being substantially less than one half the length of said elongated binder means such that said holder means for operatively engaging said front support member forms a pivot point about which said elongated binder means is rotatable by the weight of the pages clamped therein for holding said pin means within the aperture means at the apertured end of said binder means which abuts against said rear support means for preventing the rotation of said binder means about the pivot established at said holder means for hangingly suspending said pages within the elongated channel slot and clamping jaw means of said elongated binder means.

4. The file system of claim 3 wherein said front support means is an elongated, generally cylindrical rod.

5. The filing system of claim 3 wherein said holder means is loosely coupled to said front support means for enabling the opposite end of said front support means to be horizontally rotated about said pivot formed where said pin means passes through said aperture while said holder means slides along said front support means to enable individual ones of said pages to be seen without interference from pages hung on adjacent binder means.

6. The file system of claim 4 wherein said rear support means and said first and second end support members are generally rectangular in cross section.

7. The hanging file of claim 6 wherein the apertured end of said binder means includes an extension of said top portion and at least a portion of said downwardly distending sides which extend beyond the termination of the remaining portion of said sides.

8. The filing system of claim 1 wherein the end of said elongated binder means opposite said end including said aperture means including means for forming an opening into said longitudinal slot for sliding the top edges of said pages of paper between said clamping jaw means and into said elongated slot and then sliding the inserted end portion of said pages rearwardly until the top portion of said pages are operatively received substantially entirely within said elongated slot and suspended therefrom by said clamping jaw means.

9. The filing system of claim 8 wherein said elongated slot forming means includes a top and a pair of spaced apart elongated side panels integral with said top for defining said slot therebetween, and wherein said means for forming said opening includes means flared ends of said pair of side panels for framing said opening for guiding the insertion of the top portion of said pages therein and between said clamping jaw means.

10. The file system of claim 1 wherein said elongated binder means includes:

a generally rectangular, substantially elongated top portion;

a pair of substantially resilient, generally outwardly curved members integral with said top portion and extending generally downwardly therefrom, said pair of partially outwardly curved members forming an elongated channel slot through the length of said elongated binder means; and the lower ends of said pair of curved members terminating in jaw means biased into gripping contact with one another by the resiliency of said curved members for forming an elongated clamping jaw along substantially the entire length of said curved members, the ends of said curved members of said binder means opposite said apertured end including means for forming a flared opening to said elongated channel slot and between said opposed jaw means for enabling a top portion of said pages to be slidably inserted therebetween for hangingly suspending same from said binder means.

11. The filing system of claim 10 wherein each of said jaw means includes at least one generally elongated, rounded rib portion near the ends of each of said curved members, said rounder rib portions facing one another and extending substantially the length of said curved members for resiliently clamping the top portion of said pages therebetween.

12. The filing system of claim 10 wherein each of a pair of curved members includes a pair of generally parallel substantially elongated, rounded rib portions extending the length of each of said curved members and facing one another for forming said clamping jaw means.

13. The filing system of claim 10 wherein the ends of said curved members are outwardly flared apart for forming a flared opening to said channel slot and between gripping jaw means for guiding the insertion of the top portion of said pages into said elongated channel slot and between said lower clamping jaw means.

14. The filing system of claim 1 wherein each of said plurality of pin means is a generally cylindrical pin equally spaced apart at predetermined integrals along the length of the lower portion of said rear support member.

15. The filing system of claim 14 wherein said apertured end of said filing means include an extension of said top portion a predetermined distance beyond the end of said channel jaw means and said curved members, said aperture means being operatively disposed a predetermined distance away from the proximal end of said extension portion for operatively securing one of said plurality of pin means therein in a bottom-to-top manner and such that the upper surface of said extension is adapted to be retainably disposed against the lower portion of said rear support means when pages are operatively disposed within said channel slot and between said clamping jaw means for holding said means for preventing the rotation thereof about the pivot point formed at said holder means for suspending said pages in a generally vertical relationship from one another.

16. The filing system of claim 1 wherein said mounting means includes a wall rack, said wall rack including a pair of generally L-shaped angle portions having a short leg adapted to be operatively secured to a wall and a larger tapered portion adapted to be secured to each of the side members of said frame means for vertically supporting same.

17. The filing system of claim 1 wherein said mounting means is operatively disposed on a mobile a rack means adapted to be operatively disposed on the floor.

18. The filing system of claim 1 wherein said binder means further includes:

first generally included U-shaped slot-forming means having a pair of vertically distending generally elongated leg portions extending substantially the length thereof operatively coupled by a short horizontal cross member for forming an elongated slot between said distending members and having an open end opposite said horizontal cross member, said slot-forming means for operatively receiving a first plurality of pages within said slot;

a second generally inverted U-shaped slot forming means having a pair of vertically distending, generally elongated leg portions extending substantially the length thereof and operatively coupled by a short horizontal cross member for forming an elongated slot between said distending members and having an open end opposite said horizontal cross member, said slot forming means for operatively receiving a second plurality of pages within said slot;

means for operatively coupling said first and second slot forming means together including a generally horizontal top member operatively disposed above the horizontal members of said first and second channel-forming means, a substantially vertically distending middle leg operatively disposed between the first adjacent legs said first and second slot-forming means and extending substantially the length thereof, and opposite first and second leg means extending vertically downward against the outer surface of the other of said legs of said slot-forming means and extending substantially the length thereof;

notch-forming means operatively disposed on a lower end portion of said first and second distending leg means and said coupling means;

a generally inverted U-shaped binder means having a generally horizontal top portion and a pair of generally downwardly extending side members suspended from opposite sides thereof, the space between said extending side members forming an elongated channel therebetween for operatively receiving said coupling means and said first and second slot-forming means therein, and the lower end portion of each of said downwardly extending side members terminating in an inwardly disposed gripping jaw means facing one another and adapted to operatively engage the notch-forming means at the lower end portion of said first and second distending side member of said coupling means for resiliently urging said gripping jaw means toward one another to retainably clamp the top portion of said first and second plurality of pages within the first and second slot-forming means for suspendingly hanging said plurality of pages therefrom.

19. The filing system of claim 18 wherein said notch-forming means includes an outwardly disposed side portion of said first and second inwardly disposed leg means including a generally horizontally disposed notch at a rear end portion thereof such that the gripping jaw means at the lower end portion of said distending side means of said binder means is operatively disposed against the lower end portion of said opposite legs of said coupling means and said gripping jaw means being operatively disposed within the notch formed by said notch-forming means.

20. The filing system of claim 19 wherein said gripping jaw means includes at least one longitudinally extending rounded rib means.

21. The filing system of claim 19 wherein said gripping jaw means includes at least two longitudinally extending, substantially parallel and spaced apart rib means.

22. In a rack for operatively suspending a plurality of relatively large flat pages, said rack including a generally rectangular, horizontally disposed frame means having an elongated rear support member, an elongated front support member, said rear support member and said front support member being generally of equal length and being generally parallel to one another, and a pair of opposite end members operatively coupled to opposite ends of said front and rear support members for forming a generally rectangular frame means, the improvement comprising:

a plurality of substantially equally-spaced pin members operatively disposed downwardly from said rear support member; and an elongated binder means having a top portion, one end portion including means for operatively receiving one of said plurality of pin members therein, means for operatively engaging said front support member operatively coupled to said top portion of said elongated binder means, a slot-forming means for forming a substantially elongated channeled slot throughout most of the length of said binder means and having an opening at the end opposite sid aperture-containing end for receiving the top edge portion of said plurality of pages therein such that the pages are inserted rearwardly into said slot and between said clamping jaws, until the leading edge of said plurality of pages is within said slot and between said gripping jaw means, said plurality of pages being clampably retained within said slotted channel and suspended vertically therefrom.

23. The improved rack of claim 22 wherein said binder means includes a relatively resilient plastic material.

24. The improved rack means of claim 22 wherein said means for operatively engaging said front support means includes a generally squared Z-shaped holder having a generally vertical short leg and a pair of generally elongated top and bottom legs integral with said vertical short leg and extending in opposite directions therefrom, the lower elongated leg being operatively secured to the top portion of said binder means such that the relatively vertical short leg operatively positions the top elongated leg in a direction opposite to the lower leg and substantially parallel thereto for forming a channel slot between said upper long leg portion and the top surface of said binder means for operatively receiving said front support member loosely therein and operatively suspending said binder means therefrom.

25. The improved rack of claim 24 wherein said holder is operatively disposed on the top surface of said binder means a predetermined distance from said apertured end thereof which is substantially shorter than the midpoint of said binder means so that the center of gravity of the binder means when said plurality of pages are inserted therein is outward of said holder for attempting to rotate said binder means about the pivot point formed by said holder operatively engaging said front support member and attempting to rotate the apertured end into retainable abutment with the lower surface of said rear support means for preventing the rotation of said binder means and suspending it in a generally horizontal plane.

26. The improved rack of claim 25 wherein said elongated binder means includes generally inverted U-shaped member having a generally horizontal top portion and a first and second generally inwardly tapered leg members extending downwardly therefrom, the opposite open end of said leg members terminating in a pair of inwardly disposed, oppositely facing, jaw means for gripably retaining the top edge of said plurality of papers inserted within said slot means.

27. The improved rack of claim 26 wherein said jaw means includes at least one generally inwardly disposed rounded rib portion extending substantially the length of said leg members of said binder means.

28. The improved rack of claim 26 wherein said gripping jaw means includes a plurality of longitudinally extending ribs having inwardly curved rib portions facing one another on opposite end portions of said distending first and second leg means.

29. The improved rack of claim 26 wherein the end of said binder means opposite said apertured end includes slot opening for operatively receiving the top portion of said pages therein; coupling means including a top portion, first and second outwardly disposed, downwardly extending, leg means resiliently biased against the outside leg of said U-shaped channel-forming means and an intermediate downwardly extending vertical member extending between the opposite legs of said first and second U-shaped members, said downwardly disposed outer leg being resiliently disposed about one another for at least partially clamping the top edge of said plurality of pages within the U-shaped channels;

means for forming a notch at the lower end portion of the outwardly facing side of said first and second downwardly distending leg portions; and clamping means including a top portion substantially parallel to the top portion of said coupling means, a first and second downwardly distending leg portion terminating in first and second gripping means, the hollow interior between said first and second elongated arm means forming a channel slot for operatively receiving said coupling means and said first and second U-shaped means therein, gripping means at the opposite end of said first and second downwardly extending arm portions being adapted to be operatively received within the notch formed at the lower end portion of said coupling means for clamping said binder means as a single unitary member and resiliently biasing the gripping jaws against the lower end portion of said coupling means and the open end portions of said U-shaped means for clamping the top edge portion of said plurality of pages within each of said first and second U-shaped channels for suspendedly hanging said pages therefrom.

30. The improved rack of claim 29 wherein said gripping jaws includes at least one generally elongated rib means having an inwardly disposed rounded portion for operatively engaging said notch.

31. A hanging file for blueprints and the like comprising:

a generally rectangular frame means including a rear support member, a front support member and first and second side support members operatively coupling said rear and front support members;

means for mounting said frame means in a generally horizontal plane at a predetermined distance above floor level;

a plurality of pin means operatively carried on the lower surface of said rear support means;

binder means including: (1) aperture-forming means for forming an aperture adjacent a first end of binder means for operatively engaging one of said plurality of pin members; (2) binder means operatively coupled to the top surface of said hanger means a predetermined distance from said apertured end and substantially less than one half the length of said binder means for operatively engaging said front support member and suspending said binder means therefrom; (3) said binder means including the top portion and a pair of downwardly extending leg members for forming a slotted channel therebetween; (4) the end of said binder means opposite said apertured end including opening means for operatively inserting the top end of said plurality of pages into said slotted channel and between said gripping means for operatively suspending said pages within said binder means; and (5) gripping jaws operatively disposed at the lower end of said first and second leg members facing one another and resiliently biased toward one another for applying inwardly disposed pressure to the top edges of the plurality of papers disposed within the slotted channel for gripably retaining said pages therein and suspending them generally vertically therefrom.

32. The hanging file of claim 31 further including mounting means for horizontally disposing said frame means a predetermined distance above the floor.

33. The hanging file of claim 31 wherein said mounting means is operatively secured to a portion of a wall so as to operatively dispose said generally rectangular frame means a predetermined distance from the floor.

34. The hanging file of claim 31 wherein said mounting means is operably disposed on the floor for horizontally suspending said frame means a predetermined distance thereabove.

35. The horizontal file of claim 31 wherein said rear support member and said first and second side support members are generally rectangular in cross section and wherein the front ends of said first and second side support members include a pair of apertures, said front support member being a generally cylindrical rod having its opposite end portions operatively received within the apertures at the front end portions of said first and second side support members, said generally cylindrical front support member being operatively received within said hanger for suspending said binder means therefrom.

36. The hanging file of claim 35 wherein said hanger means is a generally squared Z-shaped means having a relatively short vertical leg operatively coupling a pair of oppositely disposed upper and lower elongated legs, the lower elongated leg being adapted to be fixedly secured to the top portion of said binder means while the top elongated leg is adapted to extend parallel to said top portion for forming a slot therebetween for operatively receiving said cylindrical rod within said slot for suspending said binder means therefrom.

37. The hanging file of claim 31 wherein binder means includes a top portion operatively coupling a pair of generally downwardly disposed leg portions, gripping jaw means operatively disposed adjacent the lower end portions of said leg portions and said gripping jaws operatively facing one another and being biased by said downwardly disposed leg members tightly against one another for operatively clamping the top edge portion of said plurality of pages received within said elongated channel and clamped between said jaw members.

38. The hanging file of claim 31 wherein each of said jaw means includes at least one rounded rib portion operatively disposed inwardly toward one another and extending substantially the length of said leg portions.

39. The hanging file of claim 31 wherein said gripping jaw includes a plurality of generally elongated rib members, said rib members having generally rounded, operably disposed edges facing one another for positively gripping said plurality of pages disposed therebetween.

40. The hanging file of claim 31 wherein the end of said binder means opposite said apertured end includes an opening into said elongated slot for operatively sliding the top edge portion of said plurality of pages therein and between said gripping jaws and advancing said top edge until top edge of said pages are exposed within said binder means.

41. The hanging file of claim 31 wherein the open end of said binder means includes a predetermined portion of said downwardly extending leg means outwardly flared and tapering in toward said slot means for guiding the top edge of said plurality of pages as they are inserted within said channel slot and between said jaws.

* * * * *